US012637728B2

(12) United States Patent
Cho et al.

(10) Patent No.: US 12,637,728 B2
(45) **Date of Patent: *May 26, 2026**

(54) TEMPERED MARTENSITIC STEEL HAVING LOW YIELD RATIO AND EXCELLENT UNIFORM ELONGATION, AND MANUFACTURING METHOD THEREFOR

(71) Applicant: POSCO, Pohang-si (KR)

(72) Inventors: Yeol-Rae Cho, Gwangyang-si (KR); Hwan-Goo Seong, Gwangyang-si (KR); Seong-Beom Bae, Gwangyang-si (KR)

(73) Assignee: POSCO., LTD, Pohang-si (KR)

( * ) Notice: Subject to any disclaimer, the term of this patent is extended or adjusted under 35 U.S.C. 154(b) by 550 days.

This patent is subject to a terminal disclaimer.

(21) Appl. No.: 16/471,265

(22) PCT Filed: Dec. 15, 2017

(86) PCT No.: PCT/KR2017/014845
§ 371 (c)(1),
(2) Date: Jun. 19, 2019

(87) PCT Pub. No.: WO2018/117544
PCT Pub. Date: Jun. 28, 2018

(65) Prior Publication Data

US 2019/0382864 A1 Dec. 19, 2019

(30) Foreign Application Priority Data

Dec. 23, 2016 (KR) ..... 10-2016-0178225

(51) Int. Cl.

| | |
|---|---|
| ***C21D 9/46*** | (2006.01) |
| ***C21D 1/18*** | (2006.01) |
| ***C21D 6/00*** | (2006.01) |
| ***C21D 8/02*** | (2006.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |

(52) U.S. Cl.
CPC ..... *C21D 9/46* (2013.01); *C21D 1/18* (2013.01); *C21D 6/002* (2013.01); *C21D 6/005* (2013.01); *C21D 6/008* (2013.01); *C21D 8/02* (2013.01); *C21D 8/0247* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/28* (2013.01); *C22C 38/32* (2013.01); *C21D 2211/002* (2013.01); *C21D 2211/005* (2013.01); *C21D 2211/008* (2013.01)

(58) Field of Classification Search
CPC ..... C21D 8/0247; C21D 2211/008
See application file for complete search history.

(56) References Cited

U.S. PATENT DOCUMENTS

| | | | | |
|---|---|---|---|---|
| 8,962,149 | B2 * | 2/2015 | Oikawa | C22C 38/02 428/594 |
| 2005/0034795 | A1 | 2/2005 | Motoyoshi et al. | |
| 2009/0277547 | A1 | 11/2009 | Saito et al. | |
| 2011/0048589 | A1 | 3/2011 | Matsuda et al. | |
| 2014/0096875 | A1 | 4/2014 | Ueda et al. | |
| 2014/0230969 | A1 | 8/2014 | Sugimoto et al. | |
| 2014/0322559 | A1 | 10/2014 | Becker et al. | |
| 2015/0050519 | A1 | 2/2015 | Nonaka et al. | |
| 2015/0354035 | A1 | 12/2015 | Mizuta et al. | |
| 2018/0002775 | A1 | 1/2018 | Cho et al. | |
| 2019/0003004 | A1 * | 1/2019 | Cho | C21D 8/0405 |
| 2019/0119774 | A1 | 4/2019 | Thiessen et al. | |

FOREIGN PATENT DOCUMENTS

| | | | | |
|---|---|---|---|---|
| CN | 101932745 | | 12/2010 | |
| CN | 102822375 | | 12/2012 | |
| CN | 103459634 | | 12/2013 | |
| EP | 2789699 | A1 * | 10/2014 | C21D 1/18 |
| JP | 06108152 | | 4/1994 | |

(Continued)

OTHER PUBLICATIONS

Eren Billur, Press Hardened Steels, WorldAutoSteel, https://ahssinsights.org/tag/critical-cooling-rate/ (Year: 2021).*
European Search Report—European Application No. 17884040.1, issued on Sep. 5, 2019, citing EP 2 258 887, WO 2016/177420 and WO 2016/105089.
Chinese Office Action—Chinese Application No. 201780079205.5 issued on Aug. 5, 2020, citing CN 101932745, WO 2016/105089, CN 102822375, and CN 103459634.
Japanese Office Action—Japanese Application No. 2019-533629 issued on Sep. 1, 2020, citing JP 2009-203549, JP 2006-070328, JP 2012-180594, and WO 2013/105631.
International Search Report—PCT/KR2017/014845 dated Mar. 20, 2018.

*Primary Examiner* — Jonathan Johnson
(74) *Attorney, Agent, or Firm* — CANTOR COLBURN LLP

(57) ABSTRACT

Provided is a tempered martensitic steel having a low yield ratio and an excellent uniform elongation, the tempered martensitic steel: comprising, by wt %, 0.2-0.6% of C, 0.01-2.2% of Si, 0.5-3.0% of Mn, 0.015% or less of P, 0.005% or less of S, 0.01-0.1% of Al, 0.01-0.1% of Ti, 0.05-0.5% of Cr, 0.0005-0.005% of B, 0.05-0.5% of Mo, 0.01% or less of N, and the balance of Fe and inevitable impurities; having a yield ratio of 0.4-0.6; having a product (TS*U-El), of a tensile strength and a uniform elongation, of 10,000 MPa % or more; and having a microstructure containing, by an area fraction, 90% or more of tempered martensite, 5% or less of ferrite and the balance of bainite.

8 Claims, No Drawings

(56) References Cited

FOREIGN PATENT DOCUMENTS

| | | |
|---|---|---|
| JP | 2006037205 | 2/2006 |
| JP | 2006070328 | 3/2006 |
| JP | 2006265583 | 10/2006 |
| JP | 2009203549 | 9/2009 |
| JP | 2011099149 | 5/2011 |
| JP | 2012180594 | 9/2012 |
| JP | 2014156653 | 8/2014 |
| KR | 20040057897 | 7/2004 |
| KR | 20080111549 | 12/2008 |
| KR | 20100116608 | 11/2010 |
| KR | 101082680 | 11/2011 |
| KR | 20120071470 | 7/2012 |
| KR | 20140064945 | 5/2014 |
| KR | 20140080932 | 7/2014 |
| KR | 20160078850 | 7/2016 |
| WO | 2013105631 | 7/2013 |
| WO | 2016105089 | 6/2016 |
| WO | 2016177420 | 11/2016 |
| WO | 2017111456 | 6/2017 |

* cited by examiner

TEMPERED MARTENSITIC STEEL HAVING LOW YIELD RATIO AND EXCELLENT UNIFORM ELONGATION, AND MANUFACTURING METHOD THEREFOR

TECHNICAL FIELD

The present disclosure relates to a tempered martensitic steel having a low yield ratio and an excellent uniform elongation, and a manufacturing method therefor.

BACKGROUND ART

Recently, as safety regulations for car passenger protection and fuel efficiency regulations for protecting the environment have been strengthened globally, there is a growing interest in improving rigidity and lowering weight of automobiles. For example, a stabilizer bar and a tubular torsion beam axle, and the like, of an automobile chassis, are parts for supporting a weight of an automobile body and are subjected to fatigue load during running. The application of high-strength parts is expanding in order to simultaneously secure rigidity and durability life.

Fatigue life of steel sheet for automobile parts is closely related to an increase in tensile strength and elongation. As a method of manufacturing a high-strength automobile part having a tensile strength grade of 1500 MPa or more, there are a direct hot press forming method of performing proper forming at a high temperature and die quenching, or a post heat treatment method in which cold forming is performed and then heat treating is performed. Both methods additionally include a method of performing a tempering treatment in order to increase toughness in a quenched state.

The strength to be realized by the direct hot press forming method or the post heat treatment method is varied, but it is possible to manufacture automobile parts having a tensile strength grade of 1500 MPa by using a 22MnB5 of DIN standard or a corresponding boron-added steel sheet.

Automobile parts are manufactured by performing the above-described heat treatment using hot-rolled or cold-rolled coils. That is, the tensile strength of the coil before manufacturing the parts is in a range of 500 to 800 MPa, a blank is formed to be bonded to an automobile part, heated to an austenite region at a temperature of Ac3 or higher to perform solution treatment, followed by extraction and forming in a press equipped with a cooling equipment and die quenching, alternatively, steel sheet is formed in a cold state close to a part shape, and then heated to the austenite region of Ac3 or higher to perform solution treatment, followed by extraction and die quenching or a quenching treatment. Ultimately, a phase in which martensite, or a mixed phase in which martensite and bainite exist together are formed, and thus, ultra high strength of 1500 MPa or more is obtained. However, since such a martensite-based composite phase steel is brittle, it is used by performing separate tempering in order to improve durability life and toughness.

The tempering after quenching differs depending on an intended use of the automobile parts and a required strength level, but high-temperature tempering, in a temperature range of 500° C. to 550° C., is generally performed in order to impart toughness of a martensite structure obtained after a quenching treatment. For example, provided is Patent Document 1. When subjected to high-temperature tempering, a microstructure changes from a martensite microstructure to a tempered martensite microstructure, and as compared to the quenched state, yield strength and tensile strength decrease compared to quenching strength, and from a viewpoint of a yield ratio (YS/TS), a yield ratio is in a range of 0.6 to 0.7 in a quenching step, but after tempering, the tensile strength markedly decreases, as compared to yield strength, such that the yield ratio is increased to be 0.9 or more. At the same time, uniform elongation and total elongation are increased, which is known to increase durability life of parts.

Meanwhile, low-temperature tempering is performed in a temperature range of 180° C. to 220° C., yield strength is increased, as compared to that of in the quenched state, but tensile strength is decreased, such that a yield ratio in a range of 0.7 to 0.85 is obtained. In addition, the uniform elongation and the total elongation increase somewhat compared to those of in the quenched state. Provided is Patent Document 2 on the low-temperature tempering.

That is, in the case of the high-temperature tempering, the tensile strength and the yield strength are decreased and the yield ratio increases to a range of 0.9 to 0.98, compared to those of the quenched state. In the case of the low-temperature tempering, the yield strength increases and the tensile strength decreases to have a yield ratio of 0.7 to 0.85, compared to those of the quenched state.

Meanwhile, as a weight of automobiles increases, there is an increasing demand to further improve the strength of the heat-treated parts. In order to increase the strength, when the composition of a bar regulated in boron-added heat treatment steel in the related art, that is, Mn is fixed in a range of 0.5 to 1.5%, and Cr is fixed in a range of 0.1 to 0.3% and a content of C is increased in consideration of the strength after heat treatment, quenching strength is increased in proportion to the content of C, Mn, and the like. However, when heat treatment is performed in a temperature range of 500° C. to 550° C., as in the related art, in order to impart toughness and ductility, yield strength and tensile strength are remarkably reduced, an addition effect of C, Mn, and the like, is halved, such that an expectation that the toughness will increase in proportion to the increase in strength may not be met.

PRIOR ART DOCUMENT (Patent Document 1) Japan Patent Laid-Open Publication No. 2006-037205

(Patent Document 2) Korean Patent Laid-Open Publication No. 2016-0078850

DISCLOSURE

Technical Problem

An aspect of the present disclosure is to provide tempered martensitic steel having a low yield ratio and an excellent uniform elongation, which is markedly excellent in a balance of tensile strength and uniform elongation, as compared to boron-added heat treatment steel in the related art, and a manufacturing method thereof.

Meanwhile, an aspect of the present disclosure is not limited to the above description. A subject of the present disclosure may be understood from an overall content of the present specification, and it will be understood by those skilled in the art that there is no difficulty in understanding additional subjects of the present disclosure.

Technical Solution

According to an aspect of the present disclosure, there is provided tempered martensitic steel having a low yield ratio and an excellent uniform elongation, the tempered martensitic steel: comprising, by wt %, 0.2 to 0.6% of carbon (C), 0.01 to 2.2% of silicon (Si), 0.5 to 3.0% of manganese (Mn), 0.015% or less of phosphorus (P), 0.005% or less of sulfur (S), 0.01 to 0.1% of aluminum (Al), 0.01 to 0.1% of titanium (Ti), 0.05 to 0.5% of chromium (Cr), 0.0005 to 0.005% of boron (B), 0.05 to 0.5% of molybdenum (Mo), 0.01% or less of nitrogen (N), and the balance of Fe and inevitable impurities, having a yield ratio of 0.4 to 0.6, having a product (TS*U-El), of tensile strength and uniform elongation, of 10,000 MPa % or more, and having a microstructure containing, by an area fraction, 90% or more of tempered martensite, 5% or less of ferrite and the balance of bainite.

In addition, according to another aspect of the present disclosure, there is a provided a manufacturing method of tempered martensitic steel having a low yield ratio and an excellent uniform elongation, comprising steps of, by wt %: preparing steel including 0.2 to 0.6% of carbon (C), 0.01 to 2.2% of silicon (Si), 0.5 to 3.0% of manganese (Mn), 0.015% or less of phosphorus (P), 0.005% or less of sulfur (S), 0.01 to 0.1% of aluminum (Al), 0.01 to 0.1% of titanium (Ti), 0.05 to 0.5% of chromium (Cr), 0.0005 to 0.005% of boron (B), 0.05 to 0.5% of molybdenum (Mo), 0.01% or less of nitrogen (N), and the balance of Fe and inevitable impurities; heating the steel to a temperature in a range of 850° C. to 960° C. and holding the steel for 100 to 1000 seconds; and cooling the heated steel to a cooling stop temperature of Mf−50° C. to Mf+100° C. at a cooling rate of (a martensite critical cooling rate) to 300° C./sec, and then holding the cooled steel for 3 to 30 minutes.

Further, a solution of the above-mentioned problems does not list all possible features of the present disclosure. The various features and advantages and effects of the present disclosure can be understood in more detail with reference to the following specific embodiments.

Advantageous Effects

According to the present disclosure, in manufacturing the direct hot press forming or the heat treatment-type automobile parts, the steel composition and the tempering conditions after quenching are controlled such that the balance of the tensile strength and the uniform elongation is remarkably excellent and the yield ratio is low as compared to the boron-added heat treatment steel in the related art. In addition, by securing such properties, contributions to weight reduction and durability life of the heat treatment type parts used in automobile chassis or automobile body are provided.

BEST MODE FOR INVENTION

Hereinafter, exemplary embodiments of the present disclosure will be described in detail with reference to the accompanying drawings. The disclosure may, however, be exemplified in many different forms and should not be construed as being limited to the specific embodiments set forth herein, and those skilled in the art and understanding the present disclosure could easily accomplish retrogressive inventions or other embodiments included in the scope of the present disclosure.

The present inventors have carefully examined structural factors and a fatigue stress characteristic added in a durability test after manufacturing heat treatment parts for automobiles in order to improve toughness of the heat treatment parts for automobiles. As a result, it was found that elongation affects a durability life under the condition that cyclic stress is applied under the condition that plastic deformation occurs, but tensile strength dominates the durability life under condition that the cyclic stress of less than yield strength is applied, and it was confirmed that the yield strength and elongation greatly vary depending on the conditions after quenching in the heat treatment steel.

As a result, it is possible to secure a yield ratio in a range of 0.4 to 0.6 and a tensile strength level obtained at low-temperature tempering and an uniform elongation level obtained at high-temperature tempering, by holding a temperature for a predetermined amount of time after cooling to a predetermined cooling stop temperature, rather than by heat treatment in the related art in which, after cooling to room temperature, tempering was performed at a high-temperature or a low-temperature, such that it can be confirmed that the balance of the tensile strength and the uniform elongation may be remarkably improved, thereby completing the present disclosure.

Tempered Martensitic Steel Having Low Yield Ratio and Excellent Uniform Elongation Hereinafter, a tempered martensitic steel having a low yield ratio and an excellent uniform elongation according to an aspect of the present disclosure will be described in detail.

According to an aspect of the present disclosure, there is provided a tempered martensitic steel having a low yield ratio and an excellent uniform elongation, the tempered martensitic steel: comprising, by wt %, 0.2 to 0.6% of carbon (C), 0.01 to 2.2% of silicon (Si), 0.5 to 3.0% of manganese (Mn), 0.015% or less of phosphorus (P), 0.005% or less of sulfur (S), 0.01 to 0.1% of aluminum (Al), 0.01 to 0.1% of titanium (Ti), 0.05 to 0.5% of chromium (Cr), 0.0005 to 0.005% of boron (B), 0.05 to 0.5% of molybdenum (Mo), 0.01% or less of nitrogen (N), and the balance of Fe and inevitable impurities, having a yield ratio of 0.4 to 0.6, having a product (TS*U-El), of tensile strength and uniform elongation, of 10,000 MPa % or more, and having a microstructure comprising, by an area fraction, 90% or more of tempered martensite, 5% or less of ferrite and the balance of bainite.

First, an alloy composition of the present disclosure will be described in detail. Hereinafter, an unit of a content of each element is weight %, unless otherwise specified.

C: 0.2 to 0.6%

C is the most important element for increasing hardenability of steel sheet for hot press forming and determining strength after die quenching or quenching heat treatment.

When a content of C is less than 0.2%, it is difficult to secure sufficient strength. On the other hand, when the content of C exceeds 0.6%, it is difficult to secure cold forming due to strength of a coil excessively increases in a hot-rolled coil manufacturing step and an increase in material deviation in width and length directions, and the strength is excessively high after the quenching heat treatment and it is susceptible to hydrogen delayed fracturing. Further, when welding is performed in a manufacturing process of steel sheet or a manufacturing step of the heat-treated part, there is high possibility that stress is concentrated around a weld zone and causes fracturing. Therefore, the content of C is preferably 0.2 to 0.6%.

In addition, a more preferable lower limit of the content of C may be 0.22%, and a more preferable upper limit may be 0.58%.

Si: 0.01 to 2.2%

Si, together with Mn, is an important element determining quality of a weld zone and surface quality. As the content of Si increases, there is a possibility that an oxide remains in the weld zone, which may result in failure to satisfy performance during flattening and expansion. In addition, if a content of Si increases, the possibility of causing scaling defects on the surface increases as Si is enriched on the surface of the steel sheet. Therefore, the content of Si is preferably controlled to 2.2% or less. On the other hand, Si is an impurity and it is advantageous as the content of Si is low, but in order to control the content of Si to less than 0.01%, manufacturing costs may be increased, such that a lower limit thereof is 0.01%. Therefore, the content of Si is preferably 0.01 to 2.2%.

In addition, a more preferable upper limit of the content of Si may be 2.1%, and a still more preferable upper limit thereof may be 2.0%.

Mn: 0.5 to 3.0%

Mn is an important element next to C improving hardenability of a steel sheet for hot press forming together with C, and determining the strength after die quenching or quenching heat treatment. At the same time, Mn has an effect of delaying ferrite formation as the surface temperature of the steel sheet decreases during air cooling immediately before quenching after solution treatment.

When a content of Mn is less than 0.5%, the above-described effect is insufficient. On the other hand, the content of Mn exceeds 3.0%, it is advantageous to increase the strength or to delay the transformation, but bendability of the heat-treated steel sheet may be lowered. Therefore, the content of Mn is preferably 0.5 to 3.0%.

In addition, a more preferable lower limit of the content of Mn may be 0.55%, and a more preferable upper limit may be 2.5%.

P: 0.015% or Less

P is an element inevitably contained as an impurity, and is an element which hardly affects the hot press forming or quenching strength. However, when segregated at grain boundaries in the austenite solution heating step, impact energy or fatigue characteristic is deteriorated. Therefore, the content of P is preferably to be controlled to 0.015% or less, more preferably, to be controlled to 0.010% or less.

A lower limit of the content of P is not particularly limited, but 0% may not be excluded because excessive costs are required to control the content of P to 0%.

S: 0.005% or Less

S is an element which is an impurity element and combines with Mn and exists as an elongated surfide, which deteriorates toughness of the steel sheet after the die quenching or quenching heat treatment. Therefore, it is preferable to control the content of S to 0.005% or less, and more preferably to 0.003% or less.

A lower limit of the content of S is not particularly limited, but 0% may not be excluded because excessive costs are required to control the content of S to 0%.

Al: 0.01 to 0.1%

Al is a representative element used as a deoxidizer. When the content of Al is less than 0.01%, an effect of deoxidation is insufficient. When the content of Al exceeds 0.1%, not only it is combined with N during the continuous casting process to be precipitated and causes surface defects, but also excessive oxides may remain in the weld zone during manufacturing an electric resistance welding (ERW) steel pipe.

Ti: 0.01 to 0.1%

Ti has an effect of suppressing the austenite grain growth by TiN, TiC or TiMoC precipitates during the heating process of the hot press forming process. In addition, Ti is an effective element for increasing an effective amount of B contributing to improving quenchability of the austenite microstructure to stably improving the strength after die quenching or quenching heat treatment.

When the content of Ti is less than 0.01%, the above-described effect is insufficient. On the other hand, when the content of Ti exceeds 0.1%, an effect of increasing the strength, as compared to the content being reduced, may occur, and the manufacturing costs may be increased.

Cr: 0.05 to 0.5%

Cr is an important element improving hardenability of the steel sheet for hot press forming together with Mn and C, and contributing to increasing strength after die quenching or quenching heat treatment. Cr is an element affecting the critical cooling rate to easily obtain the martensite microstructure in a martensite microstructure control process, and serving as lowering an A3 temperature in the hot press forming process. To this end, it is preferable to add Cr by 0.05% or more.

On the other hand, when the content of Cr exceeds 0.5%, there is a fear that quenchability is excessively increased required in an assembling step of a hot press forming product to deteriorate the weldability. Therefore, the content of C is preferably 0.5% or less, more preferably is 0.45% or less, and even more preferably, is 0.4% or less.

B: 0.0005 to 0.005%

B is a very useful element for increasing hardenability of a steel sheet for hot press forming, and contributing greatly to strength after die quenching or quenching heat treatment even if added in a very small amount.

When the content of B is less than 0.0005%, the above-described effect is insufficient. When the content of B exceeds 0.005%, the effect of increasing quenchability as compared to the addition amount is slowed, thereby promoting occurrence of defects in a corner portion of a continuous casting slab.

Mo: 0.05 to 0.5%

Mo is an element improving quenchability of the steel sheet for hot press forming and contributing to stabilizing quenching strength, together with Cr. Further, Mo is an effective element for expanding an austenite temperature region to a lower temperature side in an annealing process during hot rolling and cold rolling and in the annealing step of a hot press forming process, and alleviating P segregation in the steel.

When the content of Mo is less than 0.05%, the above-described effect is insufficient. When the content of Mo exceeds 0.5%, it is advantageous to increase the strength, but it is uneconomical because the effect of increasing strength is reduced with respect to the addition amount.

N: 0.01% or Less

N is an impurity, promoting precipitation of AlN, and the like during a continuous casting process, thereby promoting cracking of continuous casting slab corners. Therefore, it is preferable to control the content of N to 0.01% or less.

A lower limit of the content of N is not particularly limited, but 0% may be excluded because excessive costs are required to control it to 0%.

In the present disclosure, the remainder thereof may be iron (Fe). However, in a common manufacturing process, unintended impurities may be inevitably incorporated from raw materials or surrounding environments, such that they may not be included. These impurities are commonly known to a person skilled in the art, and are thus not specifically mentioned in this specification.

In addition to the above-described components, by weight %, one or more of 0.05 to 0.5% of Cu, 0.05 to 0.5% of Ni, and 0.05 to 0.3% of V may be further included.

Cu: 0.05 to 0.5%

Cu is an element contributing to improvement of corrosion resistance of steel. In addition, when tempering is performed to increase toughness after hot press forming, supersaturated copper is an element exhibiting an age hardening effect while precipitated as epsilon carbide.

When the content of Cu is less than 0.05%, the above-described effect is insufficient. When the content of Cu exceeds 0.5%, surface defects are caused in a manufacturing process of the steel sheet, and it is uneconomical from the viewpoint of corrosion resistance.

Ni: 0.05 to 0.5%

Ni is effective not only in improving strength and toughness of a steel sheet for hot press forming but also in increasing quenchability, and is effective in reducing hot shortening susceptibility caused by adding only Cu. In addition, there is an effect of expanding the austenite temperature region to a low-temperature side in the annealing step during hot rolling and cold rolling, the heating step of the hot press forming process.

When the content of Ni is less than 0.05%, the above-described effect is insufficient. When the content of Ni exceeds 0.5%, it is advantageous to improve the quenchability and increase the strength, but it is uneconomical because an effect of improving quenchability is reduced.

V: 0.05 to 0.3%

V is an element effective for grain refinement of steel and preventing hydrogen delayed fracturing. That is, V contributes to not only suppressing austenite grain growth in the heating process of hot rolling but also refining a final microstructure by raising a temperature in a non-recrystallization region in the hot rolling step. Such fine-grained microstructure is effective in causing grain refinement in a hot forming process, a post process to disperse impurities such as P, and the like. In addition, it exists as the precipitate in the quenching heat treatment microstructure, hydrogen in the steel is trapped and the hydrogen delayed fracturing may be suppressed.

When the content of V is less than 0.05%, the above-described effect is insufficient. When the content of V exceeds 0.3%, it is susceptible to slab cracking during continuous casting.

Hereinafter, the microstructure of the present disclosure will be described in detail.

The microstructure of the present disclosure includes 90% or more tempered martensite and 5% or less of ferrite in an area fraction, and the balance of bainite.

When the tempered martensite is less than 90%, or the ferrite exceeds 5%, it is difficult to secure a desired strength.

In this case, more preferably, it may be a single-phase tempered martensite.

In addition, the tempered martensitic steel according to the present disclosure has a product (TS*U-El) of tensile strength and uniform elongation of 10,000 MPa % or more and a yield ratio of 0.4 to 0.6.

Compared to the boron-added heat treatment steel in the related art, the balance of tensile strength and uniform elongation is remarkably excellent, and the yield ratio is low. In addition, by securing such properties, it contributes weight reduction and durability life of the heat treatment-type parts used in automobile chassis or automobile body.

In addition, the martensitic steel according to the present disclosure may have a tensile strength of 1500 MPa or more.

Manufacturing Method of Tempered Martensitic Steel Having Low Yield Ratio and Excellent Uniform Elongation Hereinafter, a manufacturing method of tempered martensitic steel having a low yield ratio and an excellent uniform elongation according to another aspect of the present disclosure will be described in detail.

According to another aspect of the present disclosure, a manufacturing method of tempered martensitic steel having a low yield ratio and an excellent uniform elongation includes steps of: preparing steel satisfying the alloy composition of the present disclosure as described above; heating the steel at a temperature in a range of 850° C. to 960° C. and holding the steel for 100 to 1000 seconds; and cooling the heated steel to a cooling stop temperature of Mf−50° C. to Mf+100° C. at a (martensitic critical cooling rate) to 300° C./sec, and then holding for 3 to 30 minutes.

Step of Preparing Steel

Steel satisfying the alloy composition of the present disclosure as described above is prepared. The present disclosure is characterized by heat treatment, and a step of preparing steel is not particularly limited, but specific examples are as follows.

For example, steel may be prepared including steps of: a step of heating slab satisfying the alloy composition of the present disclosure as described above to a temperature of 1150° C. to 1300° C.; a step of finish hot rolling the heated slab at a temperature of Ar3 to 950° C. to obtain a hot-rolled steel sheet; and a step of coiling the hot-rolled steel sheet at a temperature of 500° C. to 750° C.

By heating the slab at a temperature in the range of 1150° C. to 1300° C., a microstructure of the slab is homogenized and carbonitride precipitates such as niobium, titanium, vanadium, and the like are partially dissolved, but is still possible to suppress a slab grain growth and to prevent excessive grain growth.

When the finish hot rolling temperature is less than Ar3, hot rolling is performed in a two phase region (a region in which ferrite and austenite coexist) in which a portion of austenite is already transformed into ferrite, such that deformation resistance becomes uneven and a rolling passing ability is deteriorated, and stress is concentrated on the ferrite, which may increase a possibility of plate breakage. On the other hand, when the finish hot rolling temperature exceeds 950° C., surface defects such as sand scale, or the like, may occur.

When a coiling temperature is less than 500° C., there is a problem that the strength of the hot-rolled steel sheet is remarkably increased due to formation of a low-temperature microstructure such as martensite. Particularly, when property deviation is increased due to subcooling in a width direction of a coil, the rolling passing ability may be deteriorated in the following cold rolling process, and even when a welded steel pipe is manufactured using hot-rolled products, there is a possibility to cause forming a welded zone of a steel pipe or a welding failure. On the other hand, when the coiling temperature exceeds 750° C., internal oxidation is promoted on the surface of the steel sheet, and when the internal oxide is removed by a pickling process, a gap may be formed in a grain boundary to deteriorate a flatness of the steel pipe in the final component.

In this case, a step of cold rolling the coiled hot-rolled steel sheet to obtain a cold-rolled steel sheet; a step of continuously annealing the cold-rolled steel sheet at a temperature in a range of 750° C. to 850° C.; and a step of performing over-aging treatment on the continuously annealed cold-rolled steel sheet at a temperature in a range of 400° C. to 600° C. may be further included.

The cold rolling is not particularly limited, and the cold reduction ratio may be 40 to 70%.

When a continuous annealing temperature is less than 750° C., recrystallization may not be sufficient. When a continuous annealing temperature exceeds 850° C., not only grains are coarsened, but also a basic unit for annealing heating is increased.

The reason why an over-aging treatment temperature is controlled to 400° C. to 600° C. is that the microstructure of the cold-rolled steel sheet is constituted of a microstructure containing a portion of pearlite or bainite in a ferrite based such that the strength of the cold-rolled steel sheet has a tensile strength similar to that of the hot-rolled steel sheet.

The final tempered martensitic steel may be manufactured by using a method of slitting the prepared steel and heating the steel to an austenite region in a blank form, extracting and hot forming, and followed by quenching, a method in which an ERW steel pipe is manufactured and then heated to an austenite region and then quenched, or a method of performing quenching heat treatment after hot forming.

That is, the heating temperature and holding time in the heating step, the cooling rate, the cooling stop temperature and the holding time in the cooling and holding steps, of the present disclosure described below, are satisfied, the final tempered martensitic steel may be manufactured by using various methods such as a method of cooling using a cooling medium after hot forming or a method of performing cold cooling first and heating and then performing quenching cooling, a method in which direct hot forming and cooling is simultaneously performed into dies after heating, and the like.

Heating Step

The steel is heated to a temperature in a range of 850° C. to 960° C. to and held for 100 to 1000 seconds to be solution-treated.

When a heating temperature is less than 850° C., the temperature may be lowered during extracting the steel sheet from a heating furnace and performing hot forming, and as a result, ferrite transformation proceeds from the surface of the steel sheet, sufficient tempered martensite is not generated over the entire thickness, and the desired strength may not be obtained. On the other hand, when the heating temperature exceeds 960° C., coarsening of austenite grains is caused, enrichment of the impurity P in the austenite grain boundary is promoted, and surface decarburization accelerates and thus strength or impact energy after the final heat treatment may be lowered.

Cooling and Holding Step

After cooling the heated steel to a cooling stop temperature of Mf (martensite transformation end temperature)−50° C. to Mf+100° C. at a cooling rate of (martensite critical cooling rate) to 300° C./sec, held for 2 to 40 minutes.

The martensite critical cooling rate means a minimum cooling rate for obtaining 100% martensite, and is measures at 20° C. to 30° C./sec according to the component range of the present disclosure.

When the cooling rate is less than the martensite critical cooling rate, it is difficult to obtain a final microstructure having tempered martensite as a main phased, such that the strength may be low. When the cooling rate exceeds 300° C./sec, it is uneconomical in that the cooling facility is required to be added for increasing the cooling rate.

A cooling stop temperature is a very important factor together with the alloy composition of the present disclosure. The material is determined by the cooling stop temperature and the holding time and the material properties of the present disclosure are exhibited. Here, the cooling stop temperature may mean a temperature of a quenching bath when a method in which the heated steel is immersed in a quenching bath and cooled is used.

When the cooling stop temperature is less than Mf−50° C., the yield strength is increased and the uniform elongation is lowered, such that the yield ratio may exceed 0.6, and the product of the tensile strength and the uniform elongation (TS*U-El) may be less than 10,000 MPa %.

On the other hand, when the cooling stop temperature exceeds Mf+100° C., bainite, or the like is generated, and the tensile strength is lowered, such that the product of the tensile strength and the uniform elongation (TS*U-El) may be less than 10,000 MPa %.

In addition, and a holding time after cooling is less than 2 minutes, martensite is formed rather than tempered martensite, such that the yield strength may be increased and the uniform elongation may be lowered. On the other hand, when the holding time exceeds 40 minutes, the strength may be lowered.

Therefore, the holding time is preferably 2 to 40 minutes, more preferably is 3 to 30 minutes.

MODE FOR INVENTION

Hereinafter, the present disclosure will be described more specifically with reference to detailed exemplary embodiments. The following exemplary embodiments are merely examples for easier understanding of the present disclosure, and the scope of the present disclosure is not limited thereto.

Embodiment 1

Steel having the alloy composition shown in Table 1 below was prepared. The steel was obtained by heating homogenizing the slab having the alloy composition shown in Table 1 below in a temperature range of 1200±20° C. for 180 minutes and subjecting rough rolling and finish rolling and then coiling the slab at 650° C., a hot-rolled steel sheet having a thickness of 3.0 mm. The yield strength (YS), tensile strength (TS) and elongation (El) of the hot-rolled steel sheet were measured and are shown in Table 2 below.

The hot-rolled steel sheet was pickled, heated to 930° C. and held for 6 minutes, and then cooled to the cooling stop temperature shown in Table 2 below at a cooling rate of 30° C./sec. When the cooling stop temperature is 20° C., it was indicated using '-' and there was no additional holding time. When the cooling termination temperature exceeds 20° C., it is held for 15 minutes and then air-cooled to room temperature.

In addition, when tempering after cooling was not performed, a tempering temperature was indicated using "-" When tempering was performed after cooling, it was heated to the tempering temperature shown in Table 2 below and held for 30 minutes and then cooled.

The yield strength (YS), tensile strength (TS), uniform elongation (U-El), elongation (El), TS*U-El and yield ratio (YR) after the heat treatment were measured and were shown in Table 2 below.

Mechanical properties were measured by taking JIS No. 5 specimen in a direction parallel to the rolled steel sheet.

On the other hand, Ms and Mf are values obtained by the following Relational Expressions, and a symbol of each element in the following Relational Expressions is a value representing a content of each element in weight %.

$$Ms(^\circ C.)=512-453*C-16.9*Ni+15*Cr-9.5*Mo+217*C^2-71.5*C*Mn-67.6*C*Cr$$

$$Mf(^\circ C.)=Ms-215$$

TABLE 1

| | Chemical component (weight %, however, the * indicated elements are in ppm by weight) | | | | | | | | | | | Transformation point (° C.) | | |
|---|---|---|---|---|---|---|---|---|---|---|---|---|---|---|
| Steel | C | Si | Mn | P* | S* | Al | Ti | Cr | B* | Mo | N* | Ms | Mf | Remarks |
| 0.1 | 0.35 | 0.15 | 1.3 | 71 | 27 | 0.029 | 0.029 | 0.16 | 20 | 0.14 | 45 | 344.8 | 129.8 | Inventive Steel |

TABLE 2

| | | Before heat treatment | | | Cooling stop | Tempering | After heat treatment | | | | | | |
|---|---|---|---|---|---|---|---|---|---|---|---|---|---|
| Division | type | YS (MPa) | TS (MPa) | El (%) | temperature (° C.) | temperature (° C.) | YS (MPa) | TS (MPa) | U-El (%) | T-El (%) | TS*U-El (MPA %) | YR | Remarks |
| 1-1 | PO | 428 | 620 | 22 | — | — | 1250 | 1960 | 4.7 | 9 | 9212 | 0.638 | Comparative Example |
| 1-2 | PO | | | | 150 | — | 955 | 1815 | 6.3 | 10.4 | 11434 | 0.526 | Inventive Example |
| 1-3 | PO | | | | — | 220 | 1460 | 1800 | 5.2 | 10.1 | 9360 | 0.811 | Comparative Example |
| 1-4 | PO | | | | — | 300 | 1455 | 1720 | 3.2 | 8.0 | 5504 | 0.846 | Comparative Example |
| 1-5 | PO | | | | — | 550 | 960 | 1050 | 6.2 | 12 | 6510 | 0.914 | Comparative Example |

1-1, as Comparative Example, shows a case in which only quenching is performed, and 1-3, 1-4, and 1-5, as Comparative Examples show cases in which tempering is performed after quenching. 1-2, as Inventive Example, shows a case in which a cooling stop temperature is set to 150° C. in performing quenching. As a result of observing the microstructure, in Comparative Example 1-1, a martensitic structure was observed, and different structures were observed depending on tempering temperatures in Comparative Examples 1-3, 1-4, and 1-5 in which tempering is performed after quenching. That is, fine plate-shaped carbide was observed in a martensite lath in Comparative Example 1-3, while cementite was observed in Comparative Examples 1-4 and 1-5.

In Inventive Example 1-2, a tempered martensite microstructure in which plate-shaped carbides are precipitated in martensite lathes was observed, 96% of tempered martensite, 2% of ferrite, and 2% of bainite were observed in an area fraction.

The tempered martensite microstructure in which plate-shape carbides are precipitated in martensite laths was observed, which is similar to the case shown in Comparative Example 1-3. However, it was observed that the amount of plate-shaped carbides is greater and the size thereof is larger than that of Comparative Example 1-3. It can be considered that the low yield ratio and high TS*U-El value may be secured by the influence of the plate-shaped carbides.

As can be seen from Table 2, in the case of 1-2, Inventive Example, TS*U-El was 10,000 MPa % or more and the yield ratio was 0.6 or less.

Comparing 1-1, 1-3, 1-4, and 1-5, Comparative Examples, when the tempering temperature after quenching increases, the tensile strength was decreased continuously, and the yield strength was increased immediately after quenching, but peaked at around 220° C. and then was decreased continuously as in the tensile strength. The uniform elongation decreased rapidly after peaking at around 220° C. and then increased again when the tempering temperature increased.

The value of TS*U-El, which is the balance of the tensile strength and the uniform elongation, the TS*U-El value in the low-temperature tempering (1-3) is high compared to that of the high-temperature tempering (1-5). When the heat treatment (1-2) is performed, TS*U-El was significantly increased to 11,000 MPa % or more.

Embodiment 2

Steel having the alloy composition shown in Table 3 below was prepared. The steel was obtained by heating the slab having the alloy composition shown in Table 3 below in a range of 1200±20° C. for 180 minutes and homogenizing, and then subjecting the slab to rough rolling and finish rolling, and then coiling the slab at a coiling temperature shown in Table 4 below, which is a hot-rolled steel sheet having a thickness of 3.0 mm. The yield strength (YS), tensile strength (TS) and elongation (El) of the hot-rolled steel sheet were measured and are shown in Table 4 below.

The hot-rolled steel sheet was pickled, heated to 930° C. and held for 6 minutes, and then cooled to the cooling stop temperature shown in Table 4 below at a cooling rate of 30° C./sec. When the cooling stop temperature was 20° C., it was indicated as '-', and there was no additional holding time. When the cooling stop temperature exceeds 20° C., it was held for 15 minutes and then air-cooled to room temperature.

In addition, when tempering after cooling was not performed, the tempering temperature was indicated as '-'. When tempering after cooling was performed, it was heated to the tempering temperature shown in Table 4 below, was held for 30 minutes, and then cooled.

The yield strength (YS), tensile strength (TS), uniform elongation (U-El), elongation (El), TS*U-El and yield ratio (YR) after the heat treatment were measured and are shown in Table 4 below.

Mechanical properties were measured by taking JIS No. 5 specimen in a direction parallel to the rolled steel sheet.

Meanwhile, Ms and Mf are values obtained by the following Relational Expressions. In the following Relational Expressions, a symbol of each element represents a content of each element in weight %.

$$Ms(^\circ C.)=512-453*C-16.9*Ni+15*Cr-9.5*Mo+217*C^2-71.5*C*Mn-67.6*C*Cr$$

$$Mf(^\circ C.)=Ms-215$$

TABLE 3

| | Chemical component (weight %, however, the * indicated elements are in ppm by weight) | | | | | | | | | | | Transformation point (° C.) | | |
|---|---|---|---|---|---|---|---|---|---|---|---|---|---|---|
| Steel | C | Si | Mn | P* | S* | Al | Ti | Cr | B* | Mo | N* | Ms | Mf | Remarks |
| 2 | 0.25 | 0.15 | 1.25 | 58 | 12 | 0.030 | 0.033 | 0.4 | 22 | 0.1 | 50 | 388.3 | 173.3 | Inventive Steel |
| 3 | 0.42 | 0.15 | 1.3 | 67 | 11 | 0.035 | 0.04 | 0.1 | 10 | 0.11 | 42 | 318.6 | 103.6 | Inventive Steel |
| 4 | 0.55 | 0.10 | 1.1 | 71 | 30 | 0.03 | 0.03 | 0.2 | 21 | 0.1 | 55 | 279.8 | 64.8 | Inventive Steel |

TABLE 4

| | | | Before heat treatment | | | Cooling | | After heat treatment | | | | | | |
|---|---|---|---|---|---|---|---|---|---|---|---|---|---|---|
| Division | type | Coiling temperature (° C.) | YS (MPa) | TS (MPa) | El (%) | stop temperature (° C.) | Tempering temperature (° C.) | YS (MPa) | TS (MPa) | U-El (%) | T-El (%) | TS*U-El (MPA %) | YR | Remarks |
| 2-1 | PO | 640 | 410 | 570 | 27 | — | 220 | 1190 | 1650 | 4.9 | 11.5 | 8085 | 0.721 | Comparative Example |
| 2-2 | PO | 640 | 410 | 570 | 27 | — | 500 | 960 | 1030 | 4.3 | 12.7 | 4429 | 0.932 | Comparative Example |
| 2-3 | PO | 640 | 410 | 570 | 27 | 150 | — | 851 | 1560 | 6.8 | 9.5 | 10608 | 0.546 | Inventive Example |
| 3-1 | PO | 680 | 510 | 740 | 18 | — | 200 | 1690 | 2100 | 5.1 | 7.5 | 10710 | 0.805 | Comparative Example |
| 3-2 | PO | 680 | 510 | 740 | 18 | — | 500 | 1180 | 1290 | 4.7 | 8.0 | 6063 | 0.915 | Comparative Example |
| 3-3 | PO | 680 | 510 | 740 | 18 | 50 | — | 1120 | 1790 | 1.6 | 1.7 | 2864 | 0.626 | Comparative Example |
| 3-4 | PO | 680 | 510 | 740 | 18 | 100 | — | 1091 | 1995 | 5.9 | 8.6 | 11771 | 0.547 | Inventive Example |
| 3-5 | PO | 680 | 510 | 740 | 18 | 150 | — | 901 | 1986 | 6.0 | 9.6 | 11916 | 0.454 | Inventive Example |
| 3-6 | PO | 680 | 510 | 740 | 18 | 200 | — | 774 | 1881 | 5.7 | 8.9 | 10722 | 0.411 | Inventive Example |
| 3-7 | PO | 680 | 510 | 740 | 18 | 250 | — | 1032 | 1658 | 4.4 | 8.7 | 7295 | 0.622 | Comparative Example |
| 4-1 | PO | 700 | 680 | 800 | 17 | — | 200 | 2154 | 2650 | 3.5 | 8.5 | 9275 | 0.813 | Comparative Example |
| 4-2 | PO | 700 | 680 | 800 | 17 | — | 500 | 1339 | 1410 | 4.0 | 9.8 | 5640 | 0.950 | Comparative Example |
| 4-3 | PO | 700 | 680 | 800 | 17 | 150 | — | 1305 | 2510 | 5.1 | 9.0 | 12801 | 0.520 | Inventive Example |

In the case of Inventive Examples, the TS*U-El was at least 10,000 MPa % and the yield ratio was 0.6 or less.

When low-temperature tempering is performed at a temperature in a range of 200° C. or 220° C. in 2-1, 3-1, and 4-1, Comparative Examples, the yield strength varies depending on Steels, but the yield ratio was in a range of 0.7 to 0.85. When high-temperature tempering is performed at 500° C. in 2-2, 3-2, and 4-2, Comparative Examples, the yield ratio is in the range of 0.9 to 0.95.

In addition, except for 3-1, when tempering is performed, TS*U-El was measured to be less than 10000 MPa %. In addition, in the case of Comparative Example 3-1, TS*U-El exceeds 10,000 MPa %, but the yield ratio becomes 0.805, deviating from low yield ratio characteristic of the present disclosure.

In the case of 3-3, Comparative Example, the cooling stop temperature was 60° C., which was below Mf−50° C. proposed in the present disclosure, and specimen was abruptly ruptured to obtain low tensile strength and elongation at the time in which a strain rate during tensile deformation was 1 to 3% in tensile deformation. As a result that a fracture of the ruptured tensile specimen was observed, and grain boundary fracturing due to hydrogen delayed fracturing may be partially observed.

In the case of Comparative Examples 3 to 7, the cooling stop temperature was 60° C., exceeding Mf+100° C. proposed in the present disclosure, TS*U-El was less than 10,000 MPa %, and the yield ratio exceeded 0.6.

Embodiment 3

Steel having the alloy composition shown in Table 5 below was prepared. The steel was obtained by homogenizing the slab having the alloy composition shown in Table 5 below in a temperature range of 1200±20° C. for 180 minutes, subjecting to the slab to rough rolling and finish rolling, and then coiling the slab at a coiling temperature shown in Table 6 below, which is a hot-rolled steel sheet having a thickness of 3.0 mm. The yield strength, tensile strength (TS) and elongation (El) of the hot-rolled steel sheet were measured and were shown in Table 6 below. In addition, Steel 1 is designed to have a tempering strength grade of 1800 MPa, Steel 2 is designed to have a tempering strength grade of 1500 MPa, and Steel 3 and Steels 5 to 19 are designed to have a tempering strength grade of 2000 MPa. As a tensile strength level changes depending on a cooling stop temperature after quenching, if they are below these strengths, they were shown as Comparative Examples as shown in Table 6.

The hot-rolled steel sheet was pickled to manufacturing a picked & Oiled steel sheet (PO), and a portion thereof manufactured a cold-rolled steel sheet (CR). The cold-rolled steel sheet was cold rolled at a reduction ratio of 50% after pickling, annealed at 800° C., and over-aging treated at 450° C., thereby manufacturing the cold-rolled steel sheet. The pickled steel sheet (PO) or the cold-rolled steel sheet (CR) was heated to 930° C. and held for 6 minutes, and then cooled to the cooling stop temperature shown in Table 6 below, at a cooling rate of 30° C./sec and held for 15 minutes, and then air-cooled to room temperature.

The yield strength (YS), tensile strength (TS), uniform elongation (U-El), elongation (El), TS*U-El and yield ratio (YR) after the heat treatment were measured and are shown in Table 6 below.

Mechanical properties were measured by taking JIS No. 5 specimen in a direction parallel to the rolled steel sheet.

Meanwhile, Ms and Mf are values obtained by the following Relational Expression. In the following Relational Expressions, a symbol of each element represents a content of each element in weight %.

$$Ms(^\circ C.)=512-453*C-16.9*Ni+15*Cr-9.5*Mo+217*C^2-71.5*C*Mn-67.6*C*Cr$$

$$Mf(^\circ C.)=Ms-215$$

TABLE 5

| | Chemical component (weight %, however, the * indicated elements are in ppm by weight | | | | | | | | | | | | Transformation point (° C.) | | |
|---|---|---|---|---|---|---|---|---|---|---|---|---|---|---|---|
| Steel | C | Si | Mn | P* | S* | Al | Ti | Cr | B* | Mo | N* | Etc. | Ms | Mf | Remarks |
| 1 | 0.35 | 0.15 | 1.3 | 71 | 27 | 0.029 | 0.029 | 0.16 | 20 | 0.14 | 45 | | 344.8 | 129.8 | Inventive Steel |
| 2 | 0.25 | 0.15 | 1.25 | 58 | 12 | 0.030 | 0.033 | 0.4 | 22 | 0.1 | 50 | | 388.3 | 173.3 | Inventive Steel |
| 3 | 0.42 | 0.15 | 1.3 | 67 | 11 | 0.035 | 0.04 | 0.1 | 10 | 0.11 | 42 | | 318.6 | 103.6 | Inventive Steel |
| 4 | 0.55 | 0.10 | 1.1 | 71 | 30 | 0.030 | 0.03 | 0.2 | 21 | 0.1 | 55 | | 279.8 | 64.8 | Inventive Steel |
| 5 | 0.43 | 0.11 | 2.3 | 90 | 41 | 0.030 | 0.032 | 0.16 | 20 | 0.15 | 49 | | 282.9 | 67.9 | Inventive Steel |
| 6 | 0.43 | 0.10 | 3.1 | 70 | 29 | 0.025 | 0.040 | 0.15 | 19 | 0.13 | 50 | | 258.7 | 43.7 | Comparative Steel |
| 7 | 0.42 | 0.13 | 1.3 | 170 | 29 | 0.034 | 0.032 | 0.16 | 20 | 0.10 | 43 | | 317.9 | 102.9 | Comparative Steel |
| 8 | 0.42 | 0.10 | 1.3 | 90 | 22 | 0.030 | 0.029 | 0.20 | 19 | 0.15 | 53 | | 316.9 | 101.9 | Inventive Steel |
| 9 | 0.42 | 0.57 | 1.3 | 94 | 23 | 0.017 | 0.029 | 0.20 | 19 | 0.15 | 58 | | 316.9 | 101.9 | Inventive Steel |
| 10 | 0.43 | 1.01 | 1.3 | 95 | 25 | 0.018 | 0.030 | 0.20 | 20 | 0.15 | 55 | | 313.1 | 98.1 | Inventive Steel |
| 11 | 0.43 | 0.10 | 2.0 | 100 | 20 | 0.035 | 0.031 | 0.20 | 20 | 0.15 | 50 | | 291.6 | 76.6 | Inventive Steel |
| 12 | 0.43 | 0.98 | 2.0 | 95 | 20 | 0.026 | 0.030 | 0.20 | 20 | 0.14 | 54 | | 291.7 | 76.7 | Inventive Steel |
| 13 | 0.42 | 0.10 | 1.3 | 90 | 20 | 0.029 | 0.068 | 0.20 | 20 | 0.15 | 41 | | 316.9 | 101.9 | Inventive Steel |
| 14 | 0.42 | 0.10 | 1.3 | 90 | 22 | 0.031 | — | 0.20 | 20 | 0.15 | 42 | Nb: 0.05 | 316.9 | 101.9 | Comparative Steel |
| 15 | 0.42 | 0.15 | 1.25 | 80 | 15 | 0.032 | 0.030 | 0.17 | 14 | 0.17 | 44 | V: 0.2 | 318.6 | 103.6 | Inventive Steel |
| 16 | 0.43 | 0.20 | 1.25 | 71 | 27 | 0.020 | 0.023 | 0.18 | 20 | 0.15 | 39 | Cu: 0.2 | 314.9 | 99.9 | Inventive Steel |
| 17 | 0.43 | 0.11 | 1.3 | 59 | 21 | 0.026 | 0.029 | 0.19 | 16 | 0.19 | 54 | Cu: 0.3 Ni: 0.15 | 310.4 | 95.4 | Inventive Steel |
| 18 | 0.40 | 2.0 | 1.10 | 68 | 19 | 0.031 | 0.035 | 0.15 | 23 | 0.16 | 44 | | 330.7 | 115.7 | Inventive Steel |
| 19 | 0.40 | 2.3 | 1.10 | 75 | 21 | 0.038 | 0.029 | 0.18 | 16 | 0.18 | 56 | | 330.2 | 115.2 | Comparative Steel |
| 20 | 0.20 | 0.25 | 0.4 | 78 | 33 | 0.033 | 0.025 | 0.15 | 14 | 0.15 | 41 | | 423.2 | 208.2 | Comparative Steel |
| 21 | 0.18 | 0.15 | 1.2 | 81 | 25 | 0.033 | 0.033 | 0.3 | 25 | 0.21 | 52 | | 420.9 | 205.9 | Comparative Steel |
| 22 | 0.58 | 0.16 | 0.6 | 63 | 10 | 0.029 | 0.035 | 0.15 | 17 | 0.18 | 48 | | 292.0 | 77.0 | Inventive Steel |
| 23 | 0.63 | 0.2 | 1.2 | 90 | 13 | 0.026 | 0.029 | 0.1 | 13 | 0.1 | 43 | | 255.0 | 40.0 | Comparative Steel |

TABLE 6

| Division | type | Coling temperature (° C.) | Before heat treatment YS (MPa) | Before heat treatment TS (MPa) | Before heat treatment El (%) | Cooling stop temperature (° C.) | After heat treatment YS (MPa) | After heat treatment TS (MPa) | After heat treatment U-El (%) | After heat treatment T-El (%) | After heat treatment TS* U-El (MPa %) | After heat treatment YR | Remarks |
|---|---|---|---|---|---|---|---|---|---|---|---|---|---|
| 1-1 | PO | 650 | 428 | 620 | 22 | 150 | 955 | 1815 | 6.3 | 10.4 | 11434 | 0.526 | Inventive Example |
| 2-1 | PO | 680 | 410 | 570 | 27 | 150 | 851 | 1560 | 6.8 | 9.5 | 10608 | 0.546 | Inventive Example |
| 2-2 | PO | 680 | 410 | 570 | 27 | 130 | 880 | 1545 | 6.5 | 9.4 | 10043 | 0.570 | Inventive Example |
| 3-1 | PO | 680 | 510 | 760 | 18 | 100 | 1099 | 2015 | 5.8 | 8.5 | 11687 | 0.545 | Inventive Example |
| 3-2 | PO | 680 | 510 | 760 | 18 | 150 | 927 | 1999 | 5.9 | 8.9 | 11794 | 0.464 | Inventive Example |
| 4-1 | PO | 700 | 680 | 800 | 17 | 130 | 1305 | 2510 | 5.1 | 9.0 | 12801 | 0.520 | Inventive Example |
| 5-1 | PO | 680 | 601 | 840 | 16 | 150 | 1000 | 2020 | 5.8 | 8.9 | 11716 | 0.495 | Inventive Example |
| 6-1 | PO | 680 | 698 | 1010 | 12 | 100 | 1115 | 2135 | 5.2 | 7.9 | 11102 | 0.522 | Comparative Example |
| 7-1 | PO | 680 | 560 | 755 | 17 | 100 | 1051 | 2001 | 4.6 | 8.3 | 9205 | 0.525 | Comparative Example |
| 8-1 | PO | 680 | 574 | 781 | 19 | 150 | 901 | 1986 | 6.0 | 9.6 | 11916 | 0.454 | Inventive Example |
| 9-1 | CR | 680 | 679 | 870 | 14 | 150 | 954 | 2046 | 5.9 | 9.4 | 12071 | 0.466 | Inventive Example |
| 10-1 | PO | 680 | 731 | 964 | 17 | 60 | 1071 | 2067 | 5.8 | 8.7 | 11989 | 0.518 | Inventive Example |
| 10-2 | PO | 680 | 731 | 964 | 17 | 100 | 1061 | 2135 | 5.9 | 8.9 | 12597 | 0.497 | Inventive Example |
| 10-3 | PO | 680 | 731 | 964 | 17 | 150 | 997 | 2135 | 6.2 | 9.9 | 13237 | 0.467 | Inventive Example |
| 10-4 | PO | 680 | 731 | 964 | 17 | 200 | 860 | 2056 | 6.4 | 10 | 13158 | 0.418 | Inventive Example |
| 10-5 | PO | 680 | 731 | 964 | 17 | 250 | 957 | 1875 | 5.3 | 10.1 | 9937 | 0.500 | Comparative Example |
| 11-1 | PO | 680 | 669 | 925 | 15 | 150 | 964 | 2068 | 6.2 | 9.9 | 12822 | 0.466 | Inventive Example |
| 12-1 | PO | 680 | 647 | 906 | 18 | 150 | 1019 | 2159 | 5.9 | 8.7 | 12738 | 0.472 | Inventive Example |
| 13-1 | PO | 680 | 623 | 833 | 18 | 150 | 929 | 1975 | 6.1 | 9.6 | 12048 | 0.470 | Inventive Example |
| 14-1 | PO | 680 | 564 | 755 | 20 | 150 | 822 | 1595 | 4.1 | 6.3 | 6540 | 0.515 | Comparative Example |
| 15-1 | PO | 680 | 576 | 765 | 21 | 150 | 1050 | 2001 | 5.8 | 9.4 | 11605 | 0.525 | Inventive Example |
| 16-1 | CR | 680 | 560 | 703 | 19 | 130 | 1009 | 2043 | 6.0 | 9.9 | 12258 | 0.493 | Inventive Example |
| 17-1 | PO | 680 | 547 | 763 | 19 | 100 | 1013 | 1987 | 5.8 | 9.5 | 11525 | 0.510 | Inventive Example |
| 17-2 | PO | 680 | 547 | 763 | 19 | 150 | 927 | 1987 | 6.0 | 9.6 | 11922 | 0.467 | Inventive Example |
| 17-3 | PO | 680 | 547 | 763 | 19 | 180 | 765 | 1880 | 5.9 | 9.4 | 11092 | 0.407 | Inventive Example |
| 17-4 | PO | 680 | 547 | 763 | 19 | 250 | 1039 | 1639 | 4.5 | 9.0 | 7376 | 0.684 | Comparative Example |
| 18-1 | PO | 680 | 650 | 880 | 18 | 100 | 1068 | 2133 | 6.1 | 9.5 | 13011 | 0.501 | Inventive Example |
| 18-2 | PO | 680 | 650 | 880 | 18 | 150 | 1029 | 2100 | 6.3 | 10.0 | 13230 | 0.490 | Inventive Example |
| 19-1 | PO | 680 | 752 | 1010 | 16 | 150 | 1100 | 2260 | 6.0 | 9.9 | 13560 | 0.487 | Comparative Example |
| 20-1 | PO | 680 | 410 | 550 | 27 | 150 | 725 | 1440 | 6.2 | 10.2 | 8928 | 0.503 | Comparative Example |
| 21-1 | PO | 680 | 418 | 545 | 25 | 150 | 700 | 1431 | 6.1 | 9.9 | 8729 | 0.489 | Comparative Example |
| 22-1 | PO | 680 | 699 | 980 | 14 | 150 | 1205 | 2510 | 5.2 | 9.2 | 13052 | 0.480 | Inventive Example |
| 22-2 | PO | 680 | 699 | 980 | 14 | 100 | 1300 | 2550 | 4.5 | 8.0 | 11475 | 0.510 | Inventive Example |
| 23-1 | PO | 680 | 739 | 1025 | 12 | 150 | 1310 | 2640 | 5.0 | 8.9 | 13200 | 0.496 | Comparative Example |

In the case of Inventive Examples, satisfying all the alloy composition and manufacturing conditions proposed in the present disclosure, the TS*U-El value was 10,000 MPa % or more, and the yield ratio was 0.4 to 0.6.

In Table 6, in a case in which the tensile strength before heat treatment is 1000 MPa or more, difficulties occur in a cutting or steel pipe manufacturing process. Thus, the case was described as Comparative Examples. A case in which the TS*U-El value was less than 10,000 MPa % or the yield ratio is outside the range of 0.4 to 0.6, was also described as Comparative Examples.

In the case of 6-1, Comparative Example, the content of Mn was excessive and the tensile strength before heat treatment was 1000 MPa or more.

In the case of 7-1, Comparative Example, the TS*U-El value was less than 10,000 MPa % due to excessive content of P, which was deteriorated.

Steels 8 to 17 showed an effect of Si, Mn, Ti, Cu, and Cu—Ni addition on the material before and after the heat treatment based on Steel 8.

Steels 9 and 10 showed an increase in tensile strength before and after heat treatment as the content of Si increases. Particularly, as can be seen from 10-1 to 10-5, when the cooling stop temperature is in the range of 60° C. to 200° C., the low-yield ratio characteristic showed that the uniform elongation increases and the yield ratio decreases as the cooling stop temperature increases, but it was found that the yield ratio increased again and at the same time, the uniform elongation decreased and the TS*U-El value was less than 10,000 MPa % under the condition in which the cooling stop temperature is 250° C. as 10-5, Comparative Example.

Steels 13 to 15 are for confirming an influence of Ti, Nb, and V addition. Steels 13 and 15 satisfied the condition of the present disclosure, but in the case of Steel 14, Nb-added steel, it was found that the tensile strength after heat treatment was remarkably lowered, and the TS*U-El value was much lower than the standard proposed in the present disclosure.

Steels 16 and 17 are steels to which Cu, Cu—Ni are added, respectively. In particular, in the case of Steel 17, as a result of the influence of the cooling stop temperature, when the cooling stop temperature increases, the yield ratio gradually decreases and, when the temperature exceeds 200° C., the yield ratio increases again. Under the condition in which the cooling stop temperature is 250° C. as 17-4, Comparative Example, it exceeds the range of the yield ratio in the present disclosure.

In the case of 19-1, Comparative Example, the content of Mn was excessive, and the tensile strength before heat treatment was 1000 MPa or more.

In 20-1, Comparative Example, the content of Mn was low. In case of Comparative Example 21-1, the content of C was low, and the TS*U-El value was less than 10,000 MPa %.

In the case of 23-1, Comparative Example, the content of C was excessive and the tensile strength before heat treatment was 1000 MPa or more.

Embodiment 4

To investigate the influence of the holding time at the cooling stop temperature on the properties, The steel was obtained by homogenizing the slab having the alloy composition of the Steel type 9 shown in Table 5 below in a temperature range of 1200±20° C. for 180 minutes, subjecting to the slab to rough rolling and finish rolling, and then coiling the slab at a coiling temperature shown in Table 6 below, a hot-rolled steel sheet having a thickness of 3.0 mm. The yield strength (YS), tensile strength (TS) and elongation (El) of the hot-rolled steel sheet were measured and are shown in Table 6 below.

The hot-rolled steel sheet was pickled (PO), heated to 930° C. and held for 6 minutes, cooled to a cooling stop temperature of 150° C. at a cooling rate of 30° C./sec and held for the holding time shown in Table 7 below and then air-cooled to room temperature.

The yield strength (YS), tensile strength (TS), uniform elongation (U-El), elongation (El), TS*U-El and yield ratio (YR) after the heat treatment were measured and are shown in Table 6 below.

Mechanical properties were measured by taking JIS No. 5 specimen in a direction parallel to the rolled steel sheet.

TABLE 7

| | Before heat treatment | | | Holding | After heat treatment | | | | | | |
|---|---|---|---|---|---|---|---|---|---|---|---|
| Division | YS (MPa) | TS (MPa) | El (%) | time (min.) | YS (MPa) | TS (MPa) | U-El (%) | T-El (%) | TS* U-El (MPa %) | YR | Remarks |
| 9-1 | 410 | 570 | 27 | 1 | 1252 | 2020 | 4.7 | 7.0 | 9494 | 0.620 | Comparative Example |
| 9-2 | 410 | 570 | 27 | 3 | 1075 | 1999 | 5.1 | 8.2 | 10195 | 0.538 | Inventive Example |
| 9-3 | 410 | 570 | 27 | 5 | 1094 | 2002 | 5.6 | 9.0 | 11211 | 0.546 | Inventive Example |
| 9-4 | 510 | 740 | 18 | 10 | 1143 | 2019 | 5.5 | 8.8 | 11104 | 0.566 | Inventive Example |
| 9-5 | 510 | 740 | 18 | 15 | 1082 | 2008 | 5.6 | 8.8 | 11244 | 0.539 | Inventive Example |
| 9-6 | 510 | 740 | 18 | 30 | 1099 | 2027 | 5.7 | 9.3 | 11553 | 0.542 | Inventive Example |

As shown in Table 7, as above, when the holding time satisfies 3 to 30 minutes, the TS*U-El value was 10,000 MPa % or more, and the yield ratio was 0.4 to 0.6.

In the case of 9-1, Comparative Example, the holding time was too short, martensite was formed rather than tempered martensite, the yield strength increased, the uniform elongation decreased and the TS*U-El value was less than 10,000 MPa %, and the yield ratio exceeded 0.6.

While example embodiments have been shown and described above, it will be apparent to those skilled in the art that modifications and variations could be made without departing from the scope of the present inventive concept as defined by the appended claims.

The invention claimed is:

1. A tempered martensitic steel having a low yield ratio and an excellent uniform elongation, the tempered martensitic steel comprising:

by wt %, 0.2 to 0.6% of C, 0.01 to 2.2% of Si, 0.5 to 3.0% of Mn, 0.015% or less of P, 0.005% or less of S, 0.01 to 0.1% of Al, 0.01 to 0.1% of Ti, 0.05 to 0.5% of Cr, 0.0005 to 0.005% of B, 0.05 to 0.5% of Mo, 0.01% or less of N, and a balance of Fe and inevitable impurities;

a yield ratio of 0.4 to 0.6; and a product (TS*U-El) of a tensile strength and a uniform elongation being 10,000 MPa % or more, the uniform elongation being 5.1% to 6.8%; and a microstructure comprising, by an area fraction, 90% or more of tempered martensite, 5% or less of ferrite and a balance of bainite, wherein carbides are precipitated in martensite laths.

2. The tempered martensitic steel having a low yield ratio and an excellent uniform elongation of claim 1, further comprising: one or more of 0.05 to 0.5% of Cu, 0.05 to 0.5% of Ni, and 0.05 to 0.3% of V.

3. The tempered martensitic steel having a low yield ratio and an excellent uniform elongation of claim 1, wherein the microstructure is a single-phase tempered martensite.

4. The tempered martensitic steel having a low yield ratio and an excellent uniform elongation of claim 1, wherein the tensile strength is 1500 MPa or more.

5. A manufacturing method of a tempered martensitic steel having a low yield ratio and an excellent uniform elongation, comprising steps of, by wt %:

preparing steel including 0.2 to 0.6% of C, 0.01 to 2.2% of Si, 0.5 to 3.0% of Mn, 0.015% or less of P, 0.005% or less of S, 0.01 to 0.1% of Al, 0.01 to 0.1% of Ti, 0.05 to 0.5% of Cr, 0.0005 to 0.005% of B, 0.05 to 0.5% of Mo, 0.01% or less of N, and the balance of Fe and inevitable impurities;

heating the steel to a temperature in a range of 850° C. to 930° C. and holding the steel for 100 to 1000 seconds; and cooling the heated steel to a cooling stop temperature of Mf−50° C. to Mf+100° C. at a cooling rate of (a martensitic critical cooling rate) to 300° C./sec, and then holding the cooled steel for 2 to 40 minutes.

6. The manufacturing method of a tempered martensitic steel having a low yield ratio and an excellent uniform elongation of claim 5, wherein the steel is manufactured by steps of:

heating a slab to a temperature of 1150° C. to 1300° C.;

finish hot rolling the heated slab at $Ar_3$ to 950° C. to obtain a hot-rolled steel sheet; and coiling the hot-rolled steel sheet at a temperature in a range of 500° C. to 750° C.

7. The manufacturing method of a tempered martensitic steel having a low yield ratio and an excellent uniform elongation of claim 6, further comprising steps of:

cold rolling the coiled hot-rolled steel sheet to obtain a cold-rolled steel sheet;

continuously annealing the cold-rolled steel sheet at a temperature in a range of 750° C. to 850° C.; and performing an over-aging treatment on the continuously annealed cold-rolled steel sheet at a temperature in a range of 400° C. to 600° C.

8. The manufacturing method of a tempered martensitic steel having a low yield ratio and an excellent uniform elongation of claim 5, wherein the steel further comprises, by wt %, one or more of 0.05 to 0.5% of Cu, 0.05 to 0.5% of Ni, and 0.05 to 0.3% of V.

* * * * *